US005611110A

United States Patent [19]

Smith, Jr.

[11] Patent Number: 5,611,110

[45] Date of Patent: Mar. 18, 1997

[54] WALL INSERT AND METHOD

[76] Inventor: Allison H. Smith, Jr., 5334 Groomtown Rd., Greensboro, N.C. 27407

[21] Appl. No.: 690,026

[22] Filed: Jul. 31, 1996

Related U.S. Application Data

[63] Continuation of Ser. No. 407,333, Mar. 20, 1995.

[51] Int. Cl.[6] ..... B65D 55/00; E05F 5/02

[52] U.S. Cl. ..... 16/2.1; 16/82

[58] Field of Search ..... 16/2, 3, 82, 83, 16/86 A, 86 R; 49/460, 70; D8/402, 499, 400; 292/203, DIG. 19, DIG. 15

[56] References Cited

U.S. PATENT DOCUMENTS

| | | | |
|---|---|---|---|
| D. 257,123 | 9/1980 | Farmer, Jr. | D8/402 |
| D. 288,291 | 2/1987 | Angle | D8/400 |
| D. 288,525 | 3/1987 | Angle | D8/400 |
| D. 324,170 | 2/1992 | Owens et al. | D8/402 |
| D. 329,590 | 9/1992 | Chapman | D8/402 |
| 553,164 | 1/1896 | Kempshall | 16/2 |
| 973,568 | 10/1910 | Russell | 16/2 |
| 1,285,992 | 8/1972 | Manton | 16/2 |
| 3,133,758 | 5/1964 | Wells | 16/86 A |
| 3,397,280 | 8/1968 | Klumpp, Jr. | 16/2 |
| 3,675,959 | 7/1972 | Hansen et al. | 292/DIG. 19 |
| 3,831,986 | 8/1974 | Kobayashi | 292/201 |
| 3,864,785 | 2/1975 | Hoppock | 16/86 A |
| 4,181,339 | 1/1980 | Rigsby | 292/347 |
| 4,212,392 | 7/1980 | McKenzie | 206/571 |
| 4,532,672 | 8/1985 | Anderson | 16/86 A |
| 4,640,052 | 2/1987 | Zebedee et al. | 49/460 |
| 5,069,586 | 12/1991 | Casey | 16/2 |
| 5,473,799 | 12/1995 | Aoki | 292/251.5 |

*Primary Examiner*—Chuck Y. Mah

[57] ABSTRACT

A wall insert is provided for placement in a wall adjacent a swinging door. The insert includes a face plate and a receptacle for receiving the doorknob when the door is fully opened. The method employed allows the door to open wider than usual, while preventing damage in the event the door is opened rapidly and allowed to strike the wall. The insert may be molded from plastic and includes a face plate and cylindrically shaped receptacle affixed thereto.

9 Claims, 2 Drawing Sheets

WALL INSERT AND METHOD

This is a continuation of application Ser. No. 08/407,333 filed Mar. 20, 1995, now abandoned.

BACKGROUND OF THE INVENTION

1. Field Of The Invention

The invention herein pertains to building maintenance and particularly to a device which works in conjunction with hinged doors having protruding handles or knobs to prevent the doorknobs from damaging adjacent walls while allowing the doors to open fully.

2. Description Of The Prior Art And Objectives Of The Invention

Maintenance and repair costs for homes, office buildings, mobile homes, manufactured homes, and the like in recent years have greatly increased and are of particular concern to landlords and others who must maintain multiple dwellings in first-class condition. Maintenance crews for apartment complexes, trailer parks, and other multi-family residences are constantly repairing walls which have been inadvertently damaged by doorknobs on hinged doors that, when opened, swing against the adjacent wall to damage it. Door stops, bumpers, various hinge mounted stops and the like have all been used in the past in an effort to prevent doorknob damage to walls. Certain of these usual stops work fairly well under certain conditions, but in working, usually prevent the door from fully opening. As such, it is sometimes difficult to move furniture, wheelchairs, and the like through a doorway with a door so stopped. At other times, conventional door stops will, instead of stopping a rapidly opened door, penetrate the door, thus creating additional maintenance and repair problems.

Thus, with the known problems and disadvantages of standard door stops, the present invention was conceived and one of its objectives is to provide a device and method of use which will prevent a doorknob from damaging an adjacent wall while at the same time allowing the door to fully open.

It is yet another objective of the present invention to provide a wall insert which can be easily manufactured and adapted to a variety of wall types and constructions.

It is still another objective of the present invention to provide a wall insert which includes a face plate with a doorknob receptacle affixed thereto for surface mounting on a wall adjacent a hinged door.

It is yet still another objective of the present invention to provide a wall insert which can be quickly, accurately installed by relatively unskilled persons.

Various other objectives and advantages of the present invention will become apparent to those skilled in the art as a more detailed description is set forth below.

SUMMARY OF THE INVENTION

A wall insert and method are provided whereby a wall insert can be easily mounted in a wall adjacent a hinged swinging door to prevent the doorknob, as the door is opened, from damaging the wall. The doorknob will then enter the insert, rather than striking the wall. In addition to preventing wall damage, the insert allows the door to more fully open since the knob, which may extend approximately 5–8 centimeters from the door, will penetrate the front wall surface plane as it enters the insert.

The method of use provides the doorway with additional clearance as the steps of recessing the insert receptacle into a wall adjacent the door allows the door handle or knob to enter the receptacle, thus giving the door extra clearance as it pivots more fully. The wall insert is positioned in the wall by first forming an opening at the appropriate wall location, depending on the doorknob placement on the door. The insert can be affixed to the wall, in its preferred form by attachment of a face plate to the adjacent wall front surface with screws, adhesives, or the like.

DETAILED DESCRIPTION OF THE PREFERRED EMBODIMENT AND OPERATION OF THE INVENTION

Figure 1:
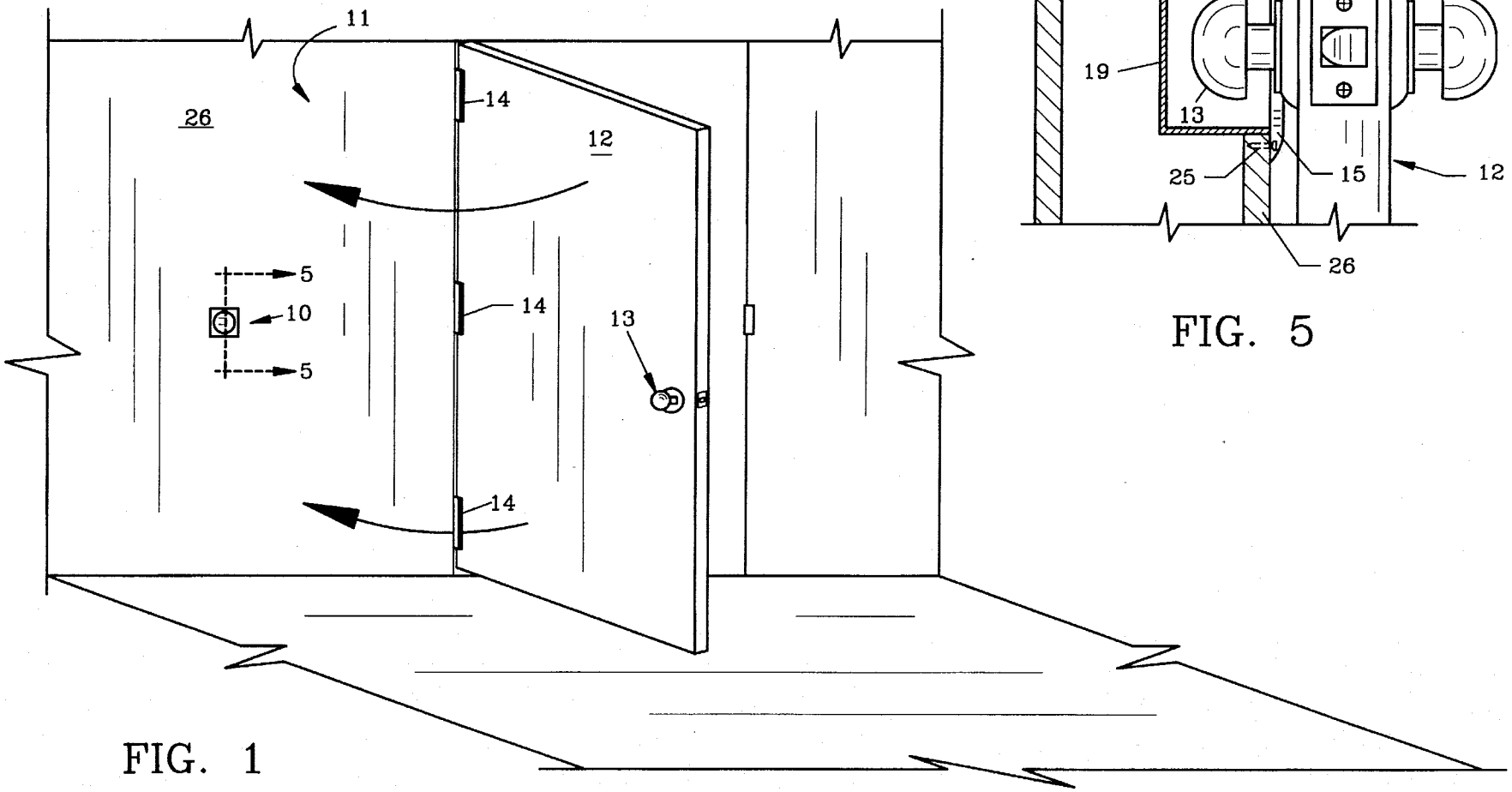
FIG. 1 illustrates in schematic fashion a conventional swinging door with the wall insert mounted in the adjacent wall.

For a better understanding of the invention and its method of use, turning now to the drawings, FIG. 1 demonstrates wall insert 10 positioned in wall 11 adjacent to hinged door 12. Wall 11 and door 12 may be conventional in homes, office buildings, mobile homes, or the like. As would be understood, door 12 when fully opened would come to rest proximate wall 11. As doorknob 13 protrudes from door 12 approximately seven and one half (7.5) centimeters, knob 13 would strike wall 11 such as when door 12 is rapidly, carelessly opened, which could cause damage both to wall 11 and knob 13. Insert 10 as shown in FIG. 1 protects wall 11 from damage by doorknob 13 and also allows door 12 to open more fully, in that greater rotation of door 12 through hinges 14 is permitted.

Figures 2, 3, 4:
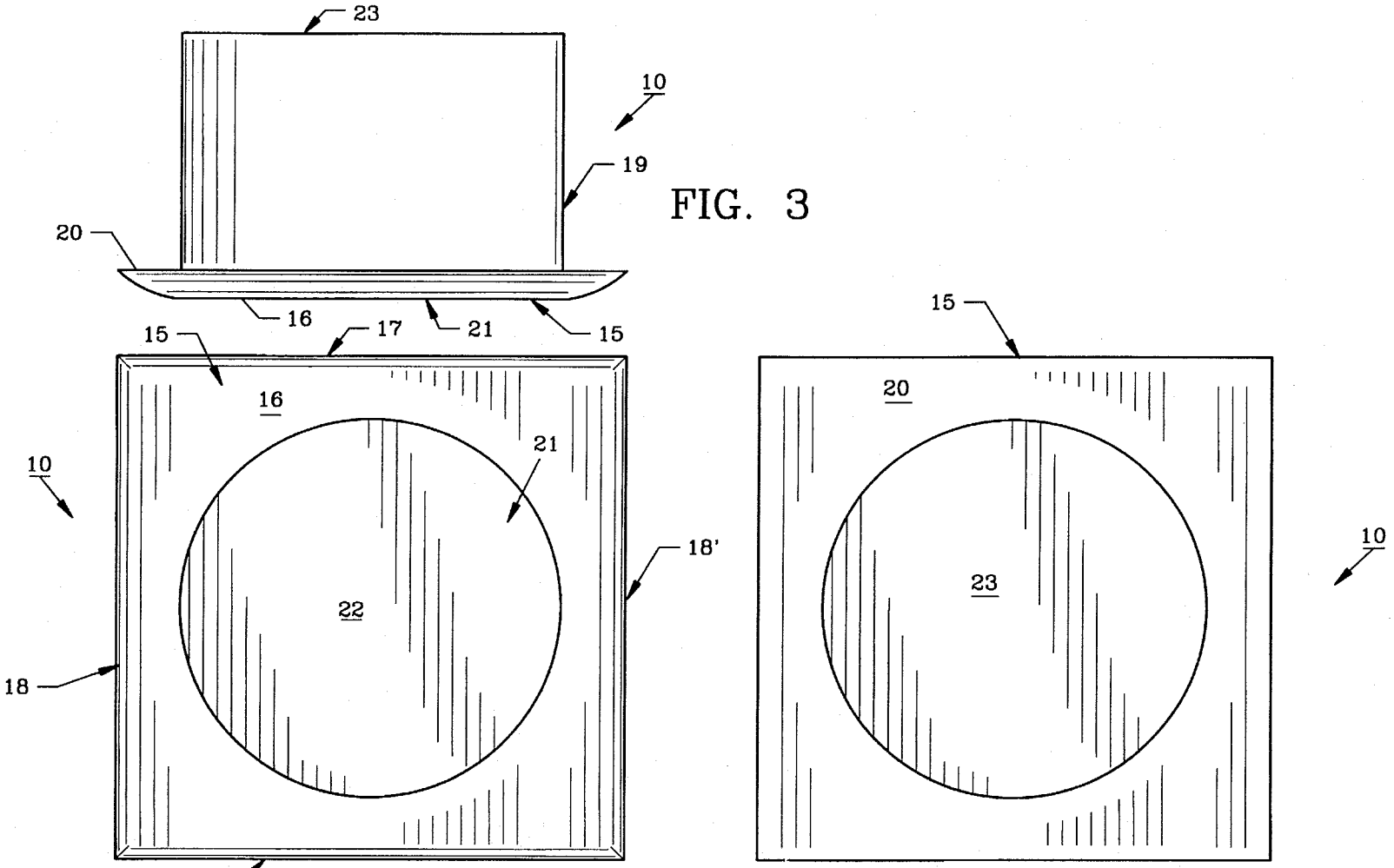
FIG. 2 shows an enlarged front elevational view of the preferred form of the insert.
FIG. 3 shows a top plan view of the preferred form of the insert as shown in FIG. 2, the bottom plan view being identical thereto.
FIG. 4 shows a rear elevational view of the insert as seen in FIG. 2.

Insert 10, the preferred form, is shown in FIG. 2 in a front elevational view with front surface 16 of face plate 15 seen with tapered edges 17, 17', 18, 18'. Extending rearwardly therefrom is receptacle 19, comprising a cylindrically shaped member which is joined, such as in molding, to rear surface 20 of face plate 15 proximate opening 21. As further shown, opening 21 is circular to coincide with the inside walls of receptacle 19. Receptacle 19 extends rearwardly slightly further than the distance doorknob 13 extends from door 12 (FIG. 1), for example, 8–10 centimeters to allow adequate nesting of doorknob 13 therein. Rear receptacle planar interior wall 22 is shown in FIG. 2 and rear receptacle planar exterior wall 23 is shown in FIG. 4. Insert 10 as seen in FIGS. 2, 3, and 4 comprises the preferred embodiment which may be molded of plastic or other suitable materials. However, other shapes and designs of the insert could be made to accomodate various doorknob sizes, shapes, or handles including the popular "French" style door handle, by altering the size and shape of opening 21 and receptacle 19 to accomodate such styles. Also, small tabs may be employed, rather than face plate 15 for use in attaching insert 10 to a wall surace.

Figure 5:
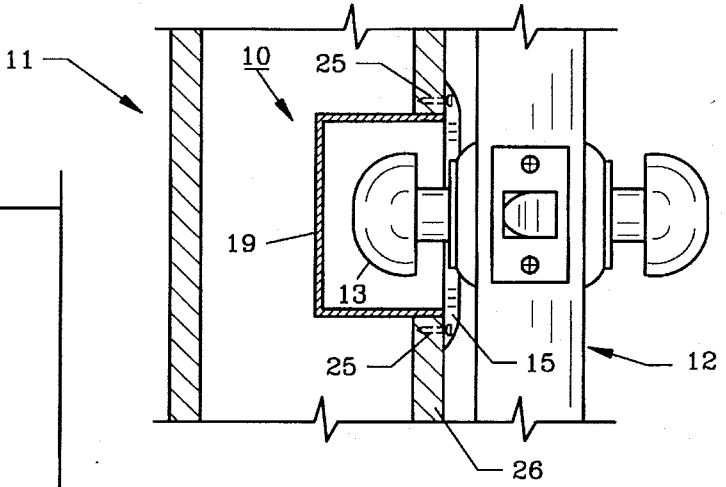
FIG. 5 demonstrates a cross-sectional view of the insert along lines 5—5 of FIG. 1 with the doorknob nestled therein as would occur with the door substantially, fully opened.

In FIG. 5, door 12 is shown with doorknob 13 positioned in insert 10. Receptacle 19 has width greater than the width of door knob 13 to allow door knob 13 to enter receptacle 19 without contact. Also, as previously stated, opening 21 defined by face plate 15 coincides with the inside walls of receptacle 19. Therefore, opening 21 also has width greater than the width of door knob 13, thus allowing door knob 13 to pass freely through opening 21, without contacting face plate 15, while entering receptacle 19. As further seen, screws 25 pass through face plate 15 to secure insert 10 within wall 11. Nails, adhesives, and other means to attach face plate 15 to wall 11 could likewise be employed.

The preferred method of the invention utilizes the steps of cutting a hole though front surface 26 of wall 11 as seen in FIG. 1, and thereafter recessing wall insert 10 therein. Insert 10 may be attached to wall 11 on front surface 26 with screws 25 as shown in FIG. 5 or, as previously mentioned, may be easily fastened with nails or a suitable glue or cement. As door 12 is opened towards wall mounted insert 10, doorknob 13 will pass through opening 21 and enter receptacle 19 as shown, thus permitting the doorway additional clearance as doorknob 13 enters recessed insert 10.

In conventional wall construction, thin sheetrock is commonly used, and thus insert 10 may be quickly installed during initial building construction and face plate 15 covered (except for opening 21), with desired paint or wallpaper. It is also standard in the building trade to place doorstops on adjacent walls to limit the door travel and help protect the wall from damage caused by a swinging door. However, such conventional stops generally limit the door opening, whereas insert 10 allows more rotation and a greater door opening, an attribute particularly beneficial when furniture or other large items are moved through a doorway from one room to another. This increased door rotation is particularly helpful in small, limited areas such as in trailers and confined rooms.

The illustrations and examples provided herein are for explanatory purposes and are not intended to limit the scope of the appended claims.

I claim:

1. A wall insert in combination with a door having a protruding knob, said wall insert for allowing said door knob to enter a recessed opening in a wall, said wall insert comprising: a face plate, a receptacle, a rear receptacle wall, said rear receptacle wall attached to said receptacle, said receptacle attached to said face plate, said face plate defining an opening to allow passage through said face plate into said receptacle, said opening and said receptacle sized greater in width than the width of said door knob to allow said door knob to freely pass through said receptacle without contact therewith, said face plate for mounting on the surface of said wall, said receptacle extending interiorly of said wall farther than the distance said door knob protrudes from said door, whereby said door knob will not contact said rear receptacle wall.

2. The wall insert of claim 1 wherein the entire perimeter of said face plate extends beyond the entire perimeter of said receptacle.

3. The wall insert of claim 1 wherein said face plate has tapered edges.

4. The wall insert of claim 1 wherein said receptacle is cylindrically shaped.

5. A wall insert in combination with a door and a building wall, said door attached to said wall, said wall insert for placement within said wall, said wall insert for allowing a door knob protruding from said door to enter said wall insert, said wall insert comprising: a receptacle for recessing said doorknob, a face plate, said face plate joined to said receptacle, said receptacle for extending interiorly of said wall farther than the distance from said doorknob protrudes from said door, said face plate for mounting on the surface of said wall, said face plate defining an opening, said opening and said receptacle having a width substantially greater than the width of said door knob to allow said door knob to freely pass therethrough without contact therewith.

6. The wall insert of claim 5 and including means to fasten said face plate to said wall, said fastening means comprising a threaded member.

7. The wall insert of claim 5 further including means to fasten said face plate to said wall, said fastening means comprising an adhesive.

8. The wall insert of claim 5 wherein said receptacle is formed from plastic.

9. The wall insert of claim 5 wherein said receptacle is cylindrically shaped.

* * * * *